US005881576A

United States Patent [19]

Davies, Jr.

[11] Patent Number: 5,881,576

[45] Date of Patent: Mar. 16, 1999

[54] SHROUD MOUNTED DOOR

[75] Inventor: Lonnie O. Davies, Jr., Newton, Iowa

[73] Assignee: Maytag Corporation, Newton, Iowa

[21] Appl. No.: 960,415

[22] Filed: Oct. 29, 1997

[51] Int. Cl.[6] ..... D06F 37/26

[52] U.S. Cl. ..... 68/3 R; 34/603; 312/228; 312/265.6

[58] Field of Search ..... 68/3 R, 139; 34/603; 220/23.91; 312/257.1, 263, 265.5, 265.6, 228

[56] References Cited

U.S. PATENT DOCUMENTS 2,296,265 9/1942 Russell ..... 68/3 R 5,363,569 11/1994 Kadakia ..... 34/603 X 5,661,914 9/1997 Millet ..... 34/603 X

*Primary Examiner*—Philip R. Coe

*Attorney, Agent, or Firm*—Zarley, McKee, Thomte, Voorhees & Sease

[57] ABSTRACT

An improved laundry appliance is provided wherein the door is mounted to a shroud, separate from the front and top panels of the cabinet. Therefore, during manufacturing assembly or repair work, the door can be shut and the operation of the appliance tested with the front and top panels removed from the appliance. After the operational testing is completed, the front and top panels can be installed to the remaining cabinet panels.

11 Claims, 5 Drawing Sheets

SHROUD MOUNTED DOOR

BACKGROUND OF THE INVENTION

In conventional laundry appliances, including front loading washing machines and dryers, the cabinet includes opposite side panels, a rear panel, and a front panel with a door pivotally mounted therein. In such conventional machines, the front panel with the door can be removed to repair internal components of the appliance, such as the motor which rotates the tub. However, to test the operation of the machine, either after manufacturing assembly or after repair work, the front panel with the door must be installed so that the door can be closed over the access opening of the tub. If further repair work is required, the front panel with the door must again be removed and then reinstalled for further operational testing. This necessity to install or reinstall the front panel and door prior to testing is time consuming and adds to manufacturing and repair costs.

Therefore, a primary objective of the present invention is the provision of an improved laundry appliance having a door mounted separately from a removable panel such that the operation of the appliance can be tested without the removable panel being installed.

Another objective of the present invention is the provision of an improved laundry appliance wherein the door is mounted to the shroud, separately from a removable panel which forms a part of the appliance cabinet.

A further objective of the present invention is the provision of an improved laundry appliance which is economical to manufacture, efficient and safe in use, and quick and easy to repair.

Still another objective of the present invention is the provision of an improved laundry appliance wherein the operation can be quickly and easily tested while a front panel is removed.

These and other objectives of the present invention will become apparent from the following description of the invention.

SUMMARY OF THE INVENTION

An improved laundry appliance is provided with a cabinet comprised of opposite side panels, a front panel and a top panel. The front and top panels are removable for access to the interior of the cabinet such that assembly, repair work and operational testing can be quickly and easily performed. The door of the appliance is pivotally mounted to the shroud which is mounted on the cabinet. The door remains in functional position when the front panel is removed from the remaining cabinet panels. Thus, the operation of the machine can be fully tested while the front panel is removed. In the preferred embodiment wherein the profile of the door extends partially into the plane of the top panel, the top panel is also removable, along with the front panel, while allowing the door to remain mounted so that the appliance can be operationally tested without reinstalling the top panel and front panel.

DETAILED DESCRIPTION OF THE DRAWINGS

Figure 1:
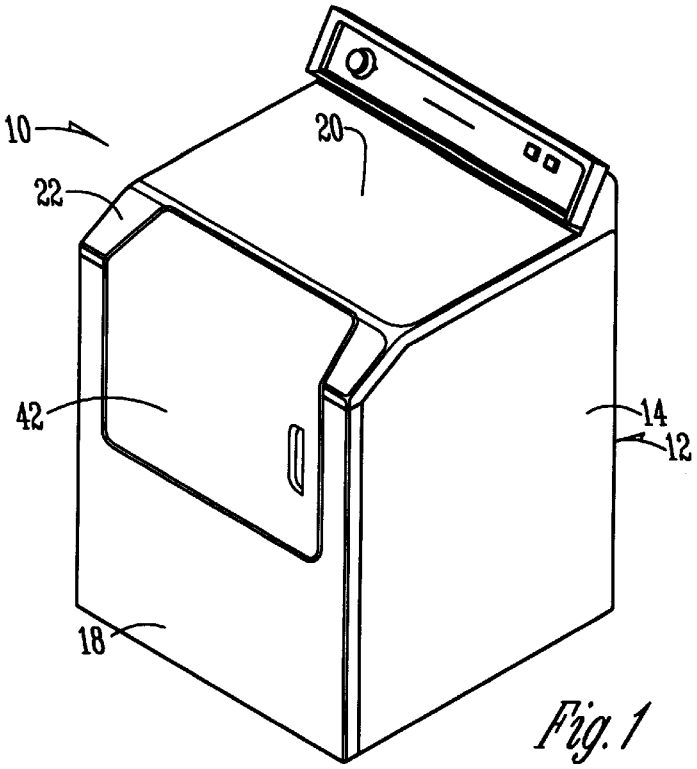
FIG. 1 is a perspective view of the improved laundry appliance of the present invention with the door closed.
Figure 2:
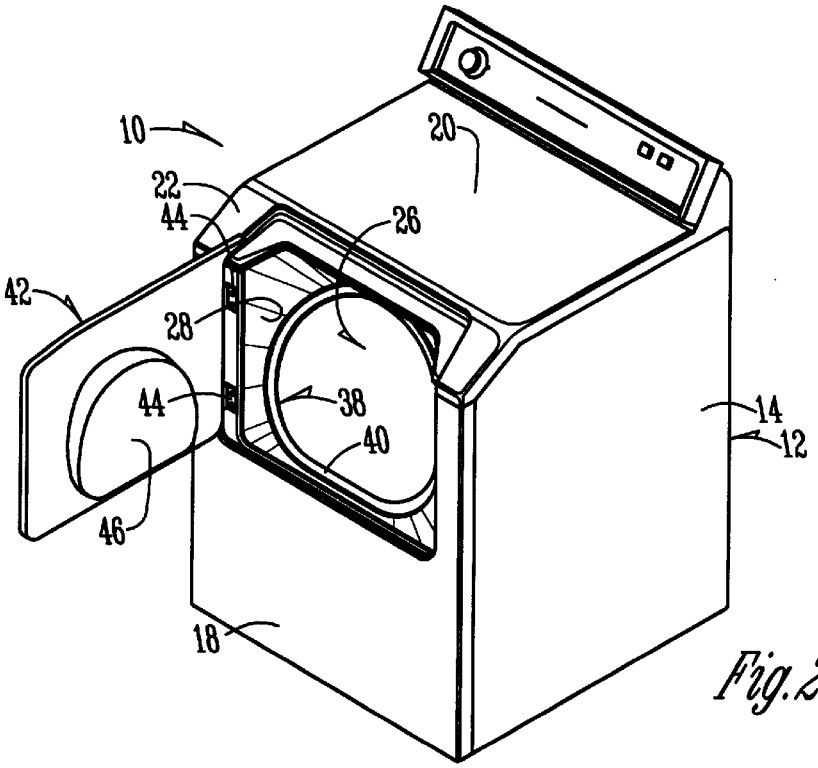
FIG. 2 is a perspective view of the improved laundry appliance of the present invention with the door open.
Figure 3:
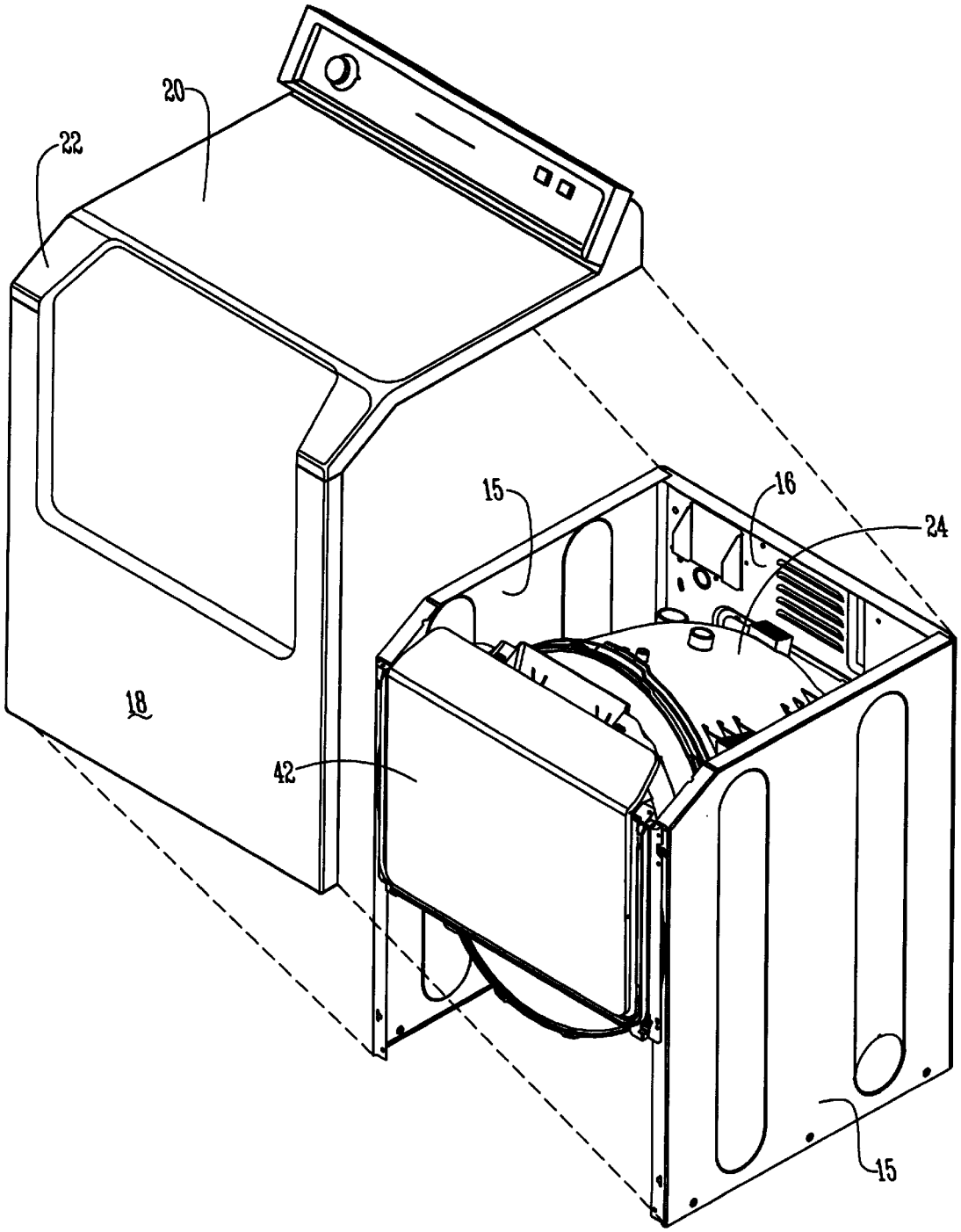
FIG. 3 is a perspective view of the appliance with the front and top panels removed from the remaining cabinet panels, and showing the door in the closed position.
Figure 4:
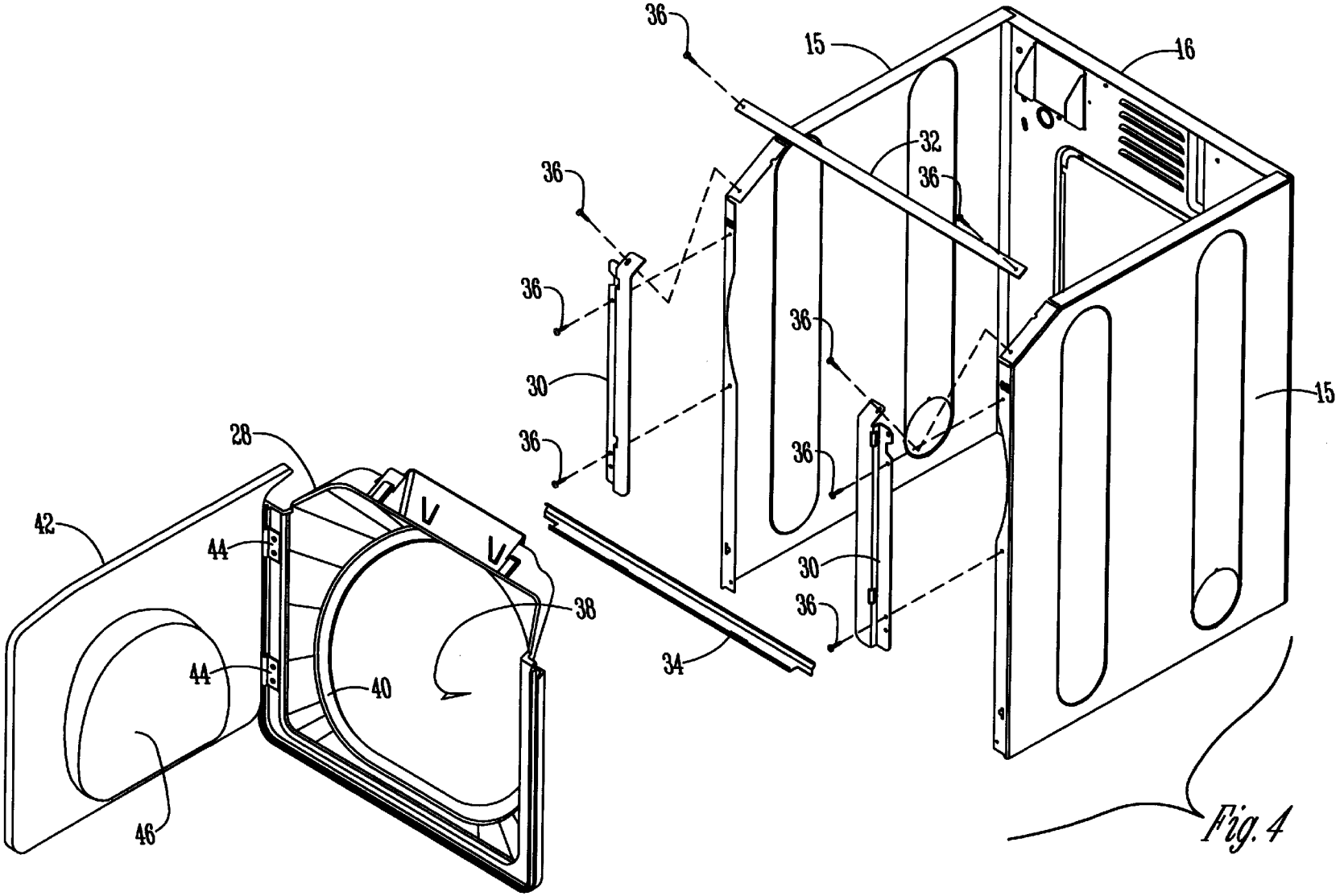
FIG. 4 is an exploded perspective view of the appliance cabinet, without the front and top panels.

The improved laundry appliance of the present invention is generally designated by the reference numeral 10 in the drawings. The appliance includes a cabinet 12 which comprises opposite side panels 14 mounted on internal frame members 15, a rear panel 16, a front panel 18, and a top panel 20. Preferably, the front panel 18 and the top panel 20 have an integral construction with a beveled panel portion 22 extending therebetween adjacent the upper front portion of the cabinet 12. The front and top panels 18, 20 are removably mounted on the frame members 15, as shown in FIG. 3.

A conventional tub 24 is mounted within the cabinet 12, with an enlarged opening 26 providing access to the tub for loading and unloading laundry. A shroud 28 is mounted to the cabinet 12, via opposite side support brackets 30, an upper bridge 32, a lower bridge 34, and a plurality of screws or bolts 36. The shroud 28 includes an opening 38 aligned with the opening 26 of the tub 24. A door boot or seal 40 extends around the shroud opening 38.

A door 42 is pivotally mounted to the shroud 28 by hinges 44. The door is pivotally movable between an open position and a closed position relative to the shroud opening 38. The door 42 includes an inner plug 46 which sealingly engages with the door boot 40 when the door is in the closed position.

Since the door 42 is mounted to the shroud 28, rather than to the front panel 18, the front panel 18 and top panel 20 can be removed from the remaining frame members 15 while the door 42 remains functionally attached to the shroud 28. This removability of the front and top panels 18, 20 without removal of the door 42 allows the operation of the appliance 10 to be checked or tested before the front and top panels 18, 20 are installed. Thus, during manufacturing assembly, or during repair work when the front panel 18 and top panel 20 are removed for access to internal appliance components, the door can be shut without the front and top panels being installed so that the machine operation can be tested. After the appliance 10 is operating properly, either during the manufacturing or during repair work, the front panel 18 and the top panel 20 can be installed.

Figure 5:
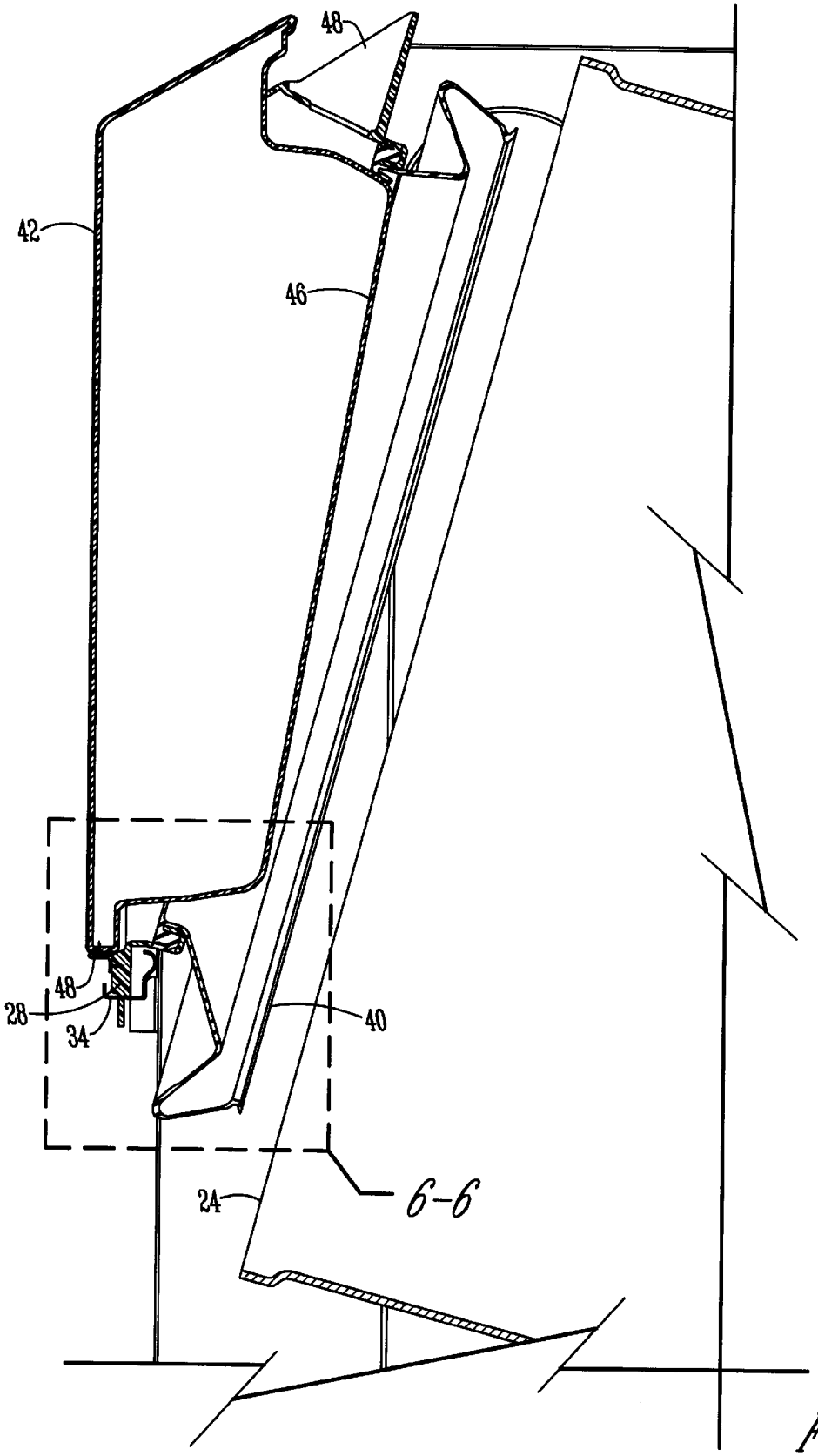
FIG. 5 is a partial sectional view of an alternative embodiment wherein the door is hinged along the bottom edge.
Figure 6:
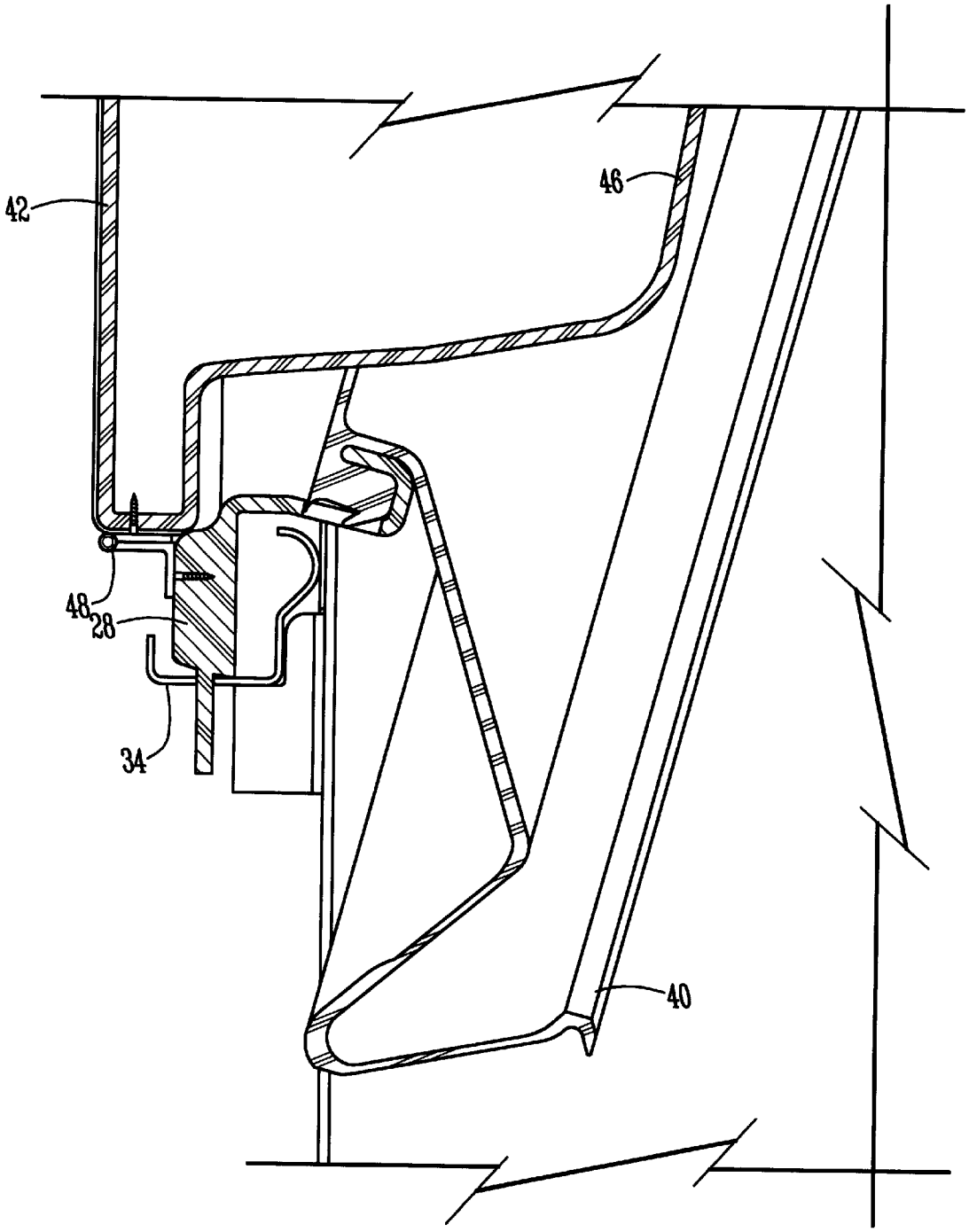
FIG. 6 is an enlarged view taken along lines 6—6 of FIG. 5.

In an alternative embodiment, the door 42 is hinged to the shroud 28 along the bottom edge of the door by one or more hinges 48, as shown in FIGS. 5 and 6.

Whereas the invention has been shown and described in connection with the preferred embodiments thereof, it will be understood that many modifications, substitutions, and additions may be made which are within the intended broad scope of the following claims. For example, in the drawings, the door is shown to extend in the planes of both the front panel 18 and top panel 20. As an alternative, the door may reside in a single plane of the front panel or top panel.

From the foregoing, it can be seen that the present invention accomplishes at least all of the stated objectives.

What is claimed is:

1. An improved laundry appliance including a cabinet with a rotatable tub mounted therein, and a shroud mounted on the cabinet, the shroud having an opening therein to provide access to the tub, comprising:

a door pivotally mounted on the shroud for movement between open and closed positions relative to the shroud opening;

a panel removably mounted on the cabinet; and the appliance being operable with the panel removed from the cabinet.

2. The improved laundry appliance of claim 1 wherein the panel has an opening such that the panel fits around the door.

3. The improved laundry appliance of claim 2 wherein the panel opening has a perimeter edge which matingly surrounds the door when the door is in the closed position.

4. The improved laundry appliance of claim 1 wherein the panel includes a substantially vertically disposed front portion.

5. The improved laundry appliance of claim 1 wherein the panel includes a substantially horizontally disposed top portion.

6. The improved laundry appliance of claim 1 wherein the panel includes a front portion and a top portion.

7. The improved laundry appliance of claim 1 wherein the door pivots about a vertical axis.

8. The improved laundry appliance of claim 1 wherein the door pivots about a horizontal axis.

9. An improved laundry appliance including a cabinet frame, opposite side panels mounted on the frame, a rear panel mounted on the frame, a tub rotatably mounted within the frame and having an opening for loading and unloading laundry, and a shroud attached to the frame and surrounding the tub opening comprising:

a door pivotally mounted to the shroud and being movable between open and closed positions relative to the tub opening;

a front panel mounted to the frame;

a top panel mounted to the frame;

at least one of the front and top panels at least partially surrounding the door and being removable from the frame without making the appliance inoperable.

10. The improved laundry appliance of claim 9 wherein the door is pivotally mounted along one side edge thereof to the shroud.

11. The improved laundry appliance of claim 9 wherein the door is pivotally mounted along the bottom edge thereof to the shroud.

* * * * *